United States Patent [19]

Weber

[11] 4,295,255

[45] Oct. 20, 1981

[54] EXPANDED COOLING JACKET ASSEMBLY

[75] Inventor: Charles M. Weber, Alliance, Ohio

[73] Assignee: The Babcock & Wilcox Company, New Orleans, La.

[21] Appl. No.: 36,720

[22] Filed: May 7, 1979

[51] Int. Cl.[3] ..... B23P 15/26; B21D 26/02; B23K 15/00

[52] U.S. Cl. ..... 29/157.3 V; 29/421 R; 228/157

[58] Field of Search ..... 29/157.3 V, 421 R; 72/58, 59; 165/156, 169; 228/157

[56] References Cited

U.S. PATENT DOCUMENTS

| | | | |
|---|---|---|---|
| 1,815,938 | 7/1931 | Trogner | 165/156 X |
| 1,990,738 | 2/1935 | La Porte | 165/156 |
| 2,137,044 | 11/1938 | Dawson | 228/157 X |
| 2,772,860 | 12/1956 | Nelson | 165/156 |
| 3,235,947 | 2/1966 | Sohlemann | 228/157 X |
| 3,549,077 | 12/1970 | Huck | 228/145 X |

*Primary Examiner*—Ervin M. Combs
*Attorney, Agent, or Firm*—Vytas R. Matas; Joseph M. Maguire

[57] ABSTRACT

A method of manufacturing a cooling jacket (10) is provided whereby a relatively thin-walled outer jacket formed as a cylinder (14') is press-fit over an inner casing (12) and the outer jacket (14') is then electron-beam welded to the inner casing (12) to set up a spiral weld (28) along the length of the cylinder (14'). The inner casing (12) has an inlet (18) and an outlet (20) hole located at opposite ends thereof which is aligned with the cylinder (14') during the pressing of the cylinder (14') onto the inner casing (12). The spiral-welded cylinder (14') is then pressurized through the inlet (18) with the outlet (20) being blocked to thereby expand the cylinder (14') between the spiral welds (28) into a series of semicircular passageways (16) for allowing cooling fluid flow.

4 Claims, 7 Drawing Figures

EXPANDED COOLING JACKET ASSEMBLY

TECHNICAL FIELD

The present invention relates to heat exchanger manufacturing methods in general and particularly to a method of manufacturing a cooling jacket assembly for control rod drive mechanisms used in nuclear reactors.

BACKGROUND ART

Cooling jacket assemblies for control rod drive mechanisms of nuclear reactors are used to cool the stator of a control rod drive motor tube. The cooling jacket assembly usually surrounds the stator of the control rod drive mechanism and consists of a metal sleeve or inner casing having a helical peripheral water channel or groove formed in its outer surface by metal cutting and grinding operations. The water channels or grooves are closed by an outer sleeve or jacket by pressing or brazing the sleeve to the inner casing. Cooling water is fed into and through the formed channels and is discharged therefrom through suitable fittings. The forementioned outer sleeve seals the formed water channel and when water is circulated therethrough the inner casing is cooled which in turn cools the stator of the control rod drive mechanism. Clearly, this known cooling assembly involves the machining on the outer diameter of the inner casing to form a spiral circumferential rectangular groove. This machining operation is time-consuming and expensive. Furthermore, the snug-fitting of the outer sleeve over the grooved inner casing does not always provide a tight seal between adjacent machined grooves. This causes short circuiting of the cooling water and cuts down on the efficiency of the cooling operation.

Another type of cooling jacket assembly is manufactured by machining a helical groove in the outside diameter of the inner casing which groove accepts with a good snug fit a continuous copper tube. The copper tube is positioned in the machined groove and is then brazed into position. Water is flowed through the copper tube cooling the inner casing which in turn cools the stator of the control rod drive mechanism. This method again involves the expensive and time-consuming process of forming a helical groove in the inner casing material added with the further operation of brazing copper tubing into the grooves.

SUMMARY OF THE INVENTION

The present invention solves the problems of the aforementioned manufacturing method as well as others by providing a method of manufacturing a cooling jacket assembly for a control rod drive mechanism which is simple, inexpensive, and provides a check on the integrity of the cooling jacket.

The method involves the snug-fitting of a relatively thin-walled outer sleeve on a relatively thick-walled inner casing having inlet and outlet passageways formed therein which inner casing is suitable for mounting on the stator portion of a control rod drive mechanism. The subassembly consisting of the outer sleeve force-fitted over the inner sleeve is then mounted in a rotatable collet and the outer sleeve is electron-beam welded to the inner casing. The electron-beam welding is done first to form a circumferential seal at one end of the outer sleeve and the head of the welder is then traversed across the length of the outer sleeve while the collet is rotating to thereby form a spiral weld along the entire length of the outer sleeve. The weld head is then stopped while the collet is left rotating to form a second sealing ring along the circumference of the outer sleeve at the opposite end. The welded subassembly is then removed from the collet and the water outlet hole is plugged while the water inlet hole is pressurized to a pressure of approximately 5000 pounds per square inch. This causes the walls of the outer sleeve to expand between the weld beads as the subassembly is pressurized, permanently deforming the outer sleeve to form a spiral cooling flow path. The pressure is then released, the water drained, and the assembly is ready for use.

Since the normal cooling water flow will be under a pressure of approximately 30 pounds per square inch, the manufactured assembly has thus automatically been checked for any leakage since the manufacture involved the application of water at 5000 pounds per square inch pressure without rupturing or developing a leak.

In view of the foregoing, it will be seen that one aspect of the present invention is to provide a method of manufacturing a cooling jacket which automatically produces an assembly checked to be leakproof.

Yet another aspect of the present invention is to provide a simple and inexpensive method of manufacturing a cooling jacket without any need for machining grooves.

These and other aspects of the present invention will be more fully understood after a review of the description of the preferred embodiment when considered along with the drawings.

FIGS. *3a–3e* show the principal manufacturing steps involved in the manufacture of the cooling jacket of the present invention.

DESCRIPTION OF THE PREFERRED EMBODIMENT

Figure 2:
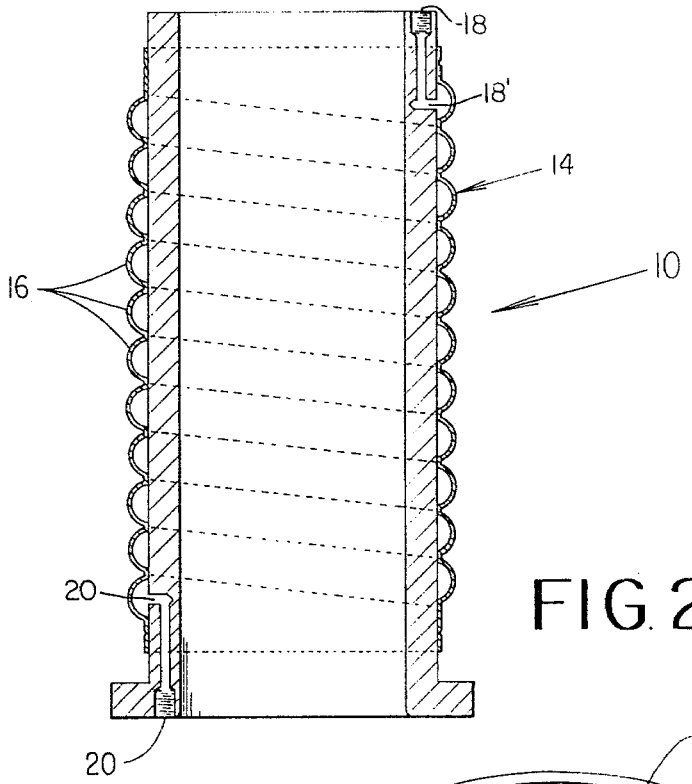
FIG. 2 is a longitudinal cross-sectional view of the FIG. 1 cooling jacket assembly.
Figure 1:
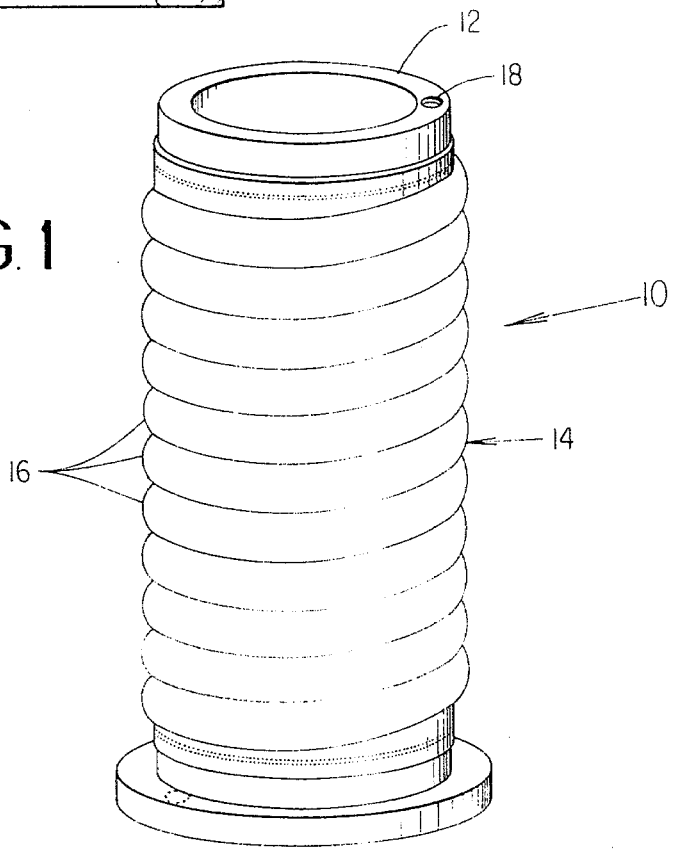
FIG. 1 is a perspective view of the cooling jacket assembly manufactured according to the method of the present invention.
Figure 3A:
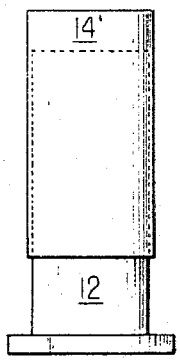
Figure 3B:
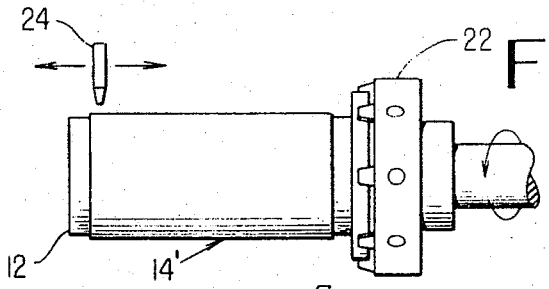
Figure 3C:
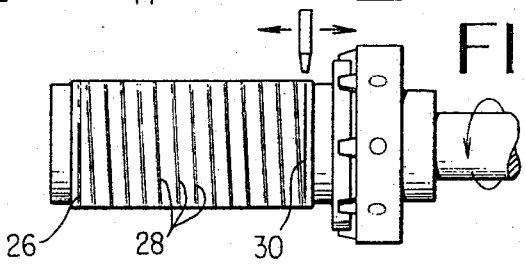
Figure 3D:
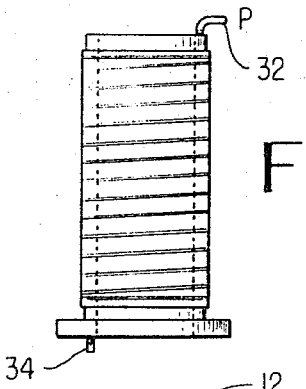
Figure 3E:
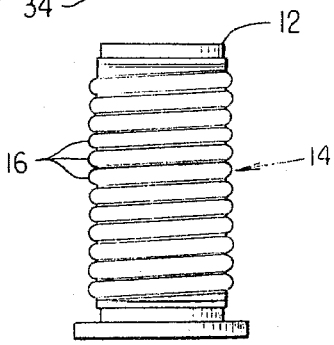

Referring now to the drawings wherein the showings are for purposes of illustrating a preferred embodiment of the invention and are not intended to limit the invention thereto, FIGS. 1 and 2 show a cooling jacket assembly 10 for a control rod drive mechanism which cooling jacket assembly 10 is manufactured according to the method of the present invention.

The manufactured cooling jacket assembly 10 has an inner casing 12 which is substantially cylindrical in nature and is intended to slip-fit over a control rod drive mechanism (not shown) of a nuclear reactor in the area of the stator. The inner casing 12 has a spirally-formed cooling water passageway assembly 14 located along the length thereof with the passageway assembly 14 being formed by a series of parallel semicircular expansions 16 forming a single spiral water path. The inner casing 12 has a water inlet hole 18 drilled into the top thereof which communicates with the first topmost semicircular expansion 16 and allows cooling water to be inleted into the passageway assembly 14. The cooling water flows along the entire spiral of the passageway assembly 14 thereby picking up heat transmitted from the stator of the control rod drive mechanism to the inner casing 12 and is exhausted at the other end of the inner casing 12 through an outlet 20 formed at the bottom of the inner casing 12 by a drilling operation.

The inner casing 12 is approximately 7.61 inches on the inside diameter and is approximately 8.60 inches on the outside diameter and is approximately 17.9 inches in length. The inner casing 12 is manufactured from a Type 403 Stainless Steel material and has the inlet 18 and outlet 20 holes drilled into it.

The passageway assembly 14 is nominally 1/16 inch thick and is approximately 13.8 inches long and is initially formed into a cylinder having an inside diameter of approximately 8.60 inches to provide for a tight fit over the inner casing 12 as will be described later. The passageway assembly 14 is manufactured from a Type 304 Stainless Steel material which was found to be more ductile and more appropriate to the manufacturing operations of the present invention.

Referring now to FIG. 3, it will be seen that in the first major manufacturing step of the present method, the passageway assembly 14 in its unformed state as a tight fitting cylinder 14' is first force-fitted over the inner casing 12. This involves the forcing or hammering of a preformed tube 14' of the precut Type 304 Stainless Steel material over the inner casing 12. Since the particular tube 14' inside diameter required to fit tightly over the inner casing 12 of the control rod drive mechanism was not readily available the Applicant found that he had to precut a length of Type 304 Stainless Steel sheet and roll it into a cylinder 14' using three roll-forming cylinders. The formed cylinder 14' was electron-beam welded along the length of the seam using a Union Carbide Electron Beam Welder Model TC30X60 set at 55 KV and 20 milliamps. The welding head of the welder was set at a travel speed of 60 inches per minute with the weld head focused on the work surface. The weld bead formed by the forementioned welding operation was then hand-ground with an abrasive wheel to make the internal diameter of the formed cylinder 14' flush. To provide for an easier force-fitting of the formed cylinder 14' to the inner casing 12, the mating surfaces of the inner casing 12 and the cylinder 14' were cleaned with Acetone to remove any dirt particles which may interfere with the forcing operation. The cylinder 14' was then forced over the inner casing 12 until it was substantially centered thereon to have the opposite ends of the cylinder 14' cover the parts 18' and 20' of the inlet and outlet holes 18 and 20 which extend at right angles to the holes 18 and 20 along the longitudinal surface of the inner casing 12.

The subassembly as previously described was then mounted in a rotating collet 22 of a Union Carbide Electron Beam Welder model TC30X60 having a weld head 24 which is movable along the longitudinal axis of the formed subassembly. The Welder was set at 55 KV 60 milliamps with a 7 inch spacing maintained between the weld head 24 and the work surface; namely, the cylinder 14. The weld head 24 was focused approximately 178 inch above the work surface. The welding operation was done in a vacuum of $7\times10-5$ TORR and with the chuck 22 rotating at a speed of 2.3 rpm.

The welding operation was as follows. The weld head 24 was maintained stationary and a first sealing weld 26 was formed along the entire circumference of the cylinder 14' thereby welding one end thereof to the inner casing 12.

Next, the weld head 24 was allowed to move along the length of the cylinder 14' while the chuck head 22 was rotating at a speed of 2.3 rpm to thereby form a spiral weld 28 along the length of the cylinder 14' having a spacing between adjacent welds 28 of approximately 1 inch. When the weld head 24 was near the end of the cylinder 14', the weld head 24 lateral motion was stopped and a circumferential sealing weld 30 was formed along the entire circumference of the cylinder 14'.

The welded subassembly was then removed from the chuck 22 and with the outlet 20 plugged with a plug 34 the inlet 18 was attached to a pressure source P by a line 32. The pressure source P was slowly pressurized and deformation of the welded cylinder 14' was seen to be initiated at approximately 1000 pounds per square inch water pressure. The pressure P was increased to approximately 5000 pounds per square inch to thereby expand the welded cylinder 14' between the adjoining 1 inch spaced welds 28 into a series of passageways 16 formed as segments of a circle having a maximum expansion at the approximate center of each segment of 0.2 inches in height. The passageway assembly 16 formed thereby was found to be suitable for carrying cooling water to a control rod drive mechanism stator.

As will be seen, since the forming of the cooling jacket assembly 10 was done with water pressures in the passageway assembly 16 of approximately 5000 pounds per square inch, the assembly 10 was automatically checked for any leakage and hence would be absolutely guaranteed of maintaining the cooling pressures required in the operation of the cooling jacket assembly 10 which rarely exceed 30 to 40 pounds per square inch.

Certain modifications and improvements will occur to those skilled in the art upon reading this Specification. As an example, although a single spiral or helix was formed by a single traverse of the welding operation, a double helix could just as easily have been formed to provide cross-current cooling flow. It will be understood that all such improvements and modifications have been deleted herein for the sake of conciseness and readability but are properly intended to fall within the scope of the following claims.

I claim:

1. A method of manufacturing a cooling jacket comprising the steps of:

providing a cylindrical inner casing having a fluid inlet and a fluid outlet formed at opposite ends therein extending through a cylindrical portion of said inner casing a;

force-fitting a cylindrical outer sleeve over said cylindrical inner casing to longitudinally align said outer sleeve over said inner casing to cover said inlet and outlet holes extending through said cylindrical portion of said inner casing;

rotating the assembly formed by fitting said outer sleeve over said inner casing at a predetermined rotational speed;

providing an electron-beam welder having a movable welding head;

maintaining the welding head of the electron-beam welder stationary at one end of said outer sleeve to form a sealing weld at the end thereof longitudinally beyond the first hole of said fluid inlet extending through said cylindrical portion of said inner casing;

traversing the welding head of the electron-beam welder along the length of said outer sleeve to form a series of parallel weld lines on said outer sleeve;

maintaining the weld head of the electron-beam welder stationary at the other end of said outer sleeve to thereby form a sealing weld thereat longitudinally beyond the second hole of said fluid outlet extending through said cylindrical portion of said inner casing; and pressurizing said inner casing by applying a pressure in excess of the normal operating pressure of said cooling jacket to either the inlet or the outlet formed therein while sealing the other to thereby expand said outer sleeve between said parallel weld lines to thereby form a fluid passageway between said inner casing and said outer sleeve.

2. A method of manufacturing a cooling jacket as set forth in claim 1 wherein said inner casing is formed as a cylinder and wherein said outer sleeve is also formed as a cylinder having an internal diameter substantially identical to the external diameter of said inner casing and wherein the external cylindrical surface of said inner casing and the internal cylindrical surface of said outer sleeve is cleaned with Acetone prior to the fitting of said outer sleeve on said inner casing.

3. A method of manufacturing a cooling jacket as set forth in claim 1 wherein said step of welding said outer sleeve to said inner casing is done with an electron-beam welder forming a circumferential weld bead at opposite ends of said cylindrical outer sleeve and a spiral weld bead between said circumferential weld beads.

4. A method of manufacturing a cooling jacket as set forth in claim 3 wherein said step of pressurizing said inner casing includes the sealing of the outlet of said inner casing and applying 5000 pounds per square inch water pressure to the inlet of said inner casing.

* * * * *